United States Patent [19]

Campo

[11] 4,258,248

[45] Mar. 24, 1981

[54] INSTANT HOT AIR WELCOME MAT

[76] Inventor: Louis Campo, 99-12 K Waverly Ave., Patchogue, N.Y. 11722

[21] Appl. No.: 5,371

[22] Filed: Jan. 22, 1979

[51] Int. Cl.[3] ..... F24H 3/04

[52] U.S. Cl. ..... 219/369; 219/370; 219/213; 34/243 R

[58] Field of Search ..... 219/368, 366, 367, 373, 219/518, 521, 369, 388, 370, 374, 375, 376, 380–382, 213; 34/239, 243 R, 236–238

[56] References Cited

U.S. PATENT DOCUMENTS

| | | | |
|---|---|---|---|
| 2,779,856 | 1/1957 | Fahner | 219/368 |
| 3,007,256 | 11/1961 | Rouy | 34/239 |
| 3,299,529 | 1/1967 | Roberts et al. | 219/373 |
| 3,315,064 | 4/1967 | Carlberg et al. | 219/518 |

FOREIGN PATENT DOCUMENTS

| | | | |
|---|---|---|---|
| 824689 | 12/1951 | Fed. Rep. of Germany | 219/213 |

*Primary Examiner*—B. A. Reynolds
*Assistant Examiner*—Bernard Roskoski
*Attorney, Agent, or Firm*—Charles E. Baxley

[57] ABSTRACT

An instant hot air welcome mat comprising a hot air forming chamber and a snow, sleet, ice and water receiving chamber separated by a lowered partition. A blower in the hot air chamber forces heated air into the drain chamber when an electric switch is actuated by stepping on a grill comprising a part of the device's cover. Spring-loaded screws secure the cover to the chambers.

4 Claims, 6 Drawing Figures

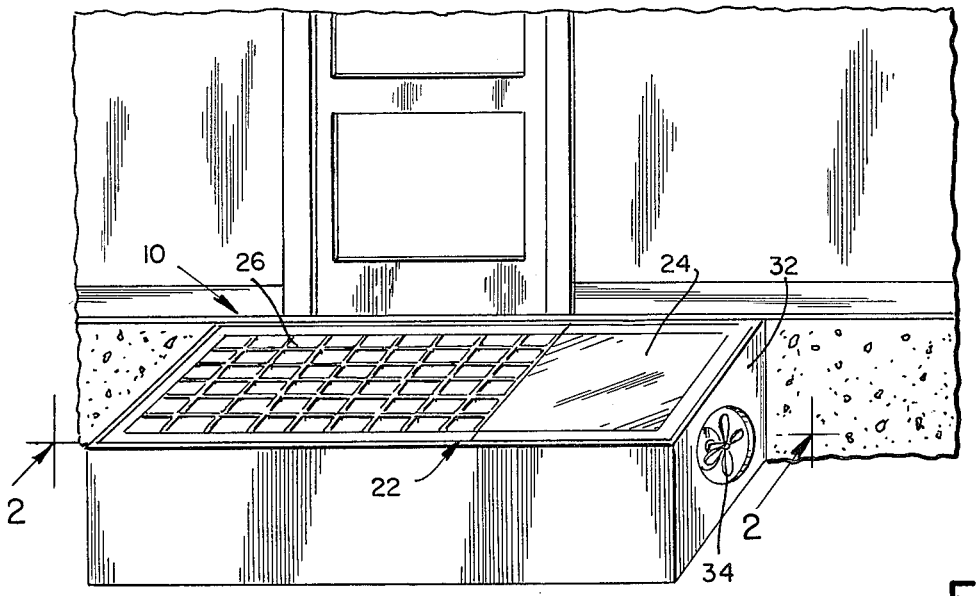
FIG. 1
FIG. 2
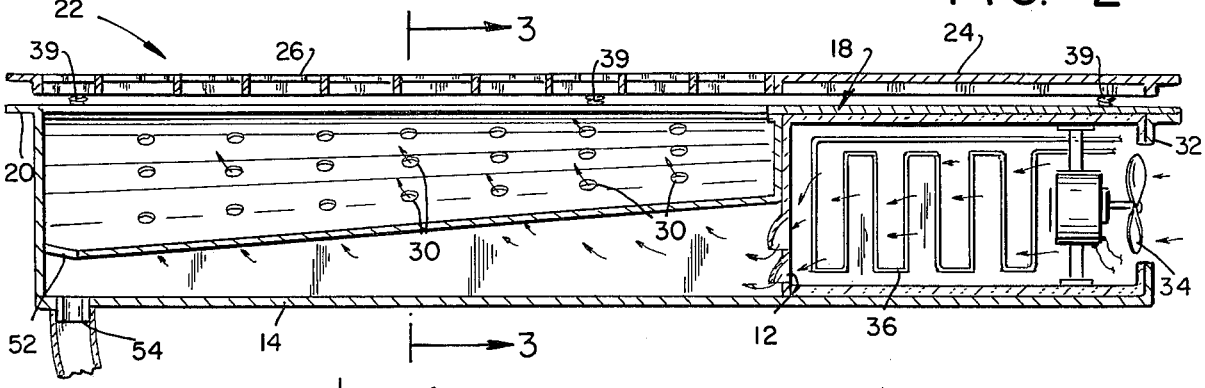
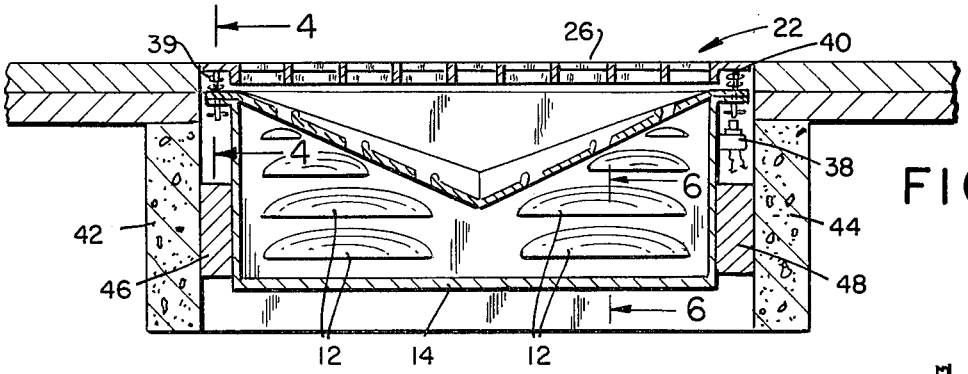
FIG. 3
FIG. 4
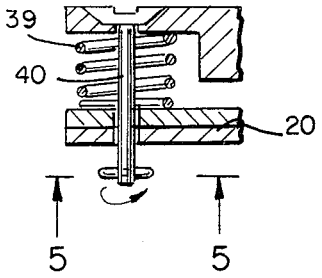
FIG. 5
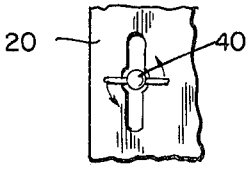
FIG. 6
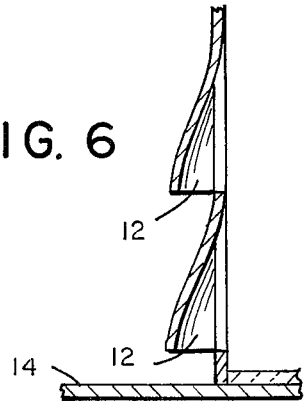

INSTANT HOT AIR WELCOME MAT

SUMMARY OF THE INVENTION

The invention relates to a welcome door mat which is heated by air supplied by an electronic heating element and a blower.

An object of the invention is to provide means for melting snow, ice and drying mat foorwear of a person when entering through a doorway of any building or dwelling.

Another object of the invention is to provide a device which may be permanently built into a new or old building or dwelling.

A further object of the invention is to provide a device of the above character provided with an electronic heat element and a blower operated through a time delay switch.

Yet another object is to provide such a device which is simple and dependable in operation and can be manufactured at a reasonable cost.

These and other objects of the invention will become apparent from the following description and the appended drawing.

In the drawing:

FIG. 1 is a perspective view of the instant hot air welcome mat;

FIG. 2 is a longitudinal cross-section of the device;

FIG. 3 is a cross-section taken on line 3—3 of FIG. 2;

FIG. 4 is an enlarged detail view of one of the spring-loaded screws used for the flush plate;

FIG. 5 is a section on line 5—5 of FIG. 4; and

FIG. 6 is a partial section of the louvered partition.

Referring now to the drawing in detail, the device comprises a housing 10 divided by a lowered partition 12 into chambers 14 and 16. The housing formed with flange 20 extending outwardly of the walls of the housing for securing a flush vertically displaceable plate 22, which is formed with a solid portion 24 and a grilled portion 26. Secured in chamber 14 is a canted pan 28 formed with upwardly punched dimple holes 30 for allowing the passage of water into chamber 14, preferably of galvanized sheet metal.

Mounted in wall 32 is a blower 34 and a heat element 36 for supplying heat to chamber 14 through the openings in the lowered partition 12. There is further provided a trip switch 38 secured to a wall of the housing 10 for energizing blower 34 and heat element 36. The switch includes a timing mechanism (not shown) for opening the circuit after a predetermined time following its closing. The switch is closed when a person steps on the vertically displaceable cover 22, thus depressing it against the bias of springs 39 and moving rod 40 downward to actuate the switches. This type of switch is particularly adaptable for indoor installations. For outdoor installations an electronic eye switch (not whown) could be used, on open porches, terraces, etc.

FIG. 3 illustrates the method of permanent mounting of the device in a floor framing 42, 44, employing blocking 46, 48. It will be noted that the upper face of displaceable cover 22 is aligned flush with the surface of finish floor 50.

In use, a person entering a doorway steps on grill portion 26 of cover 22, thereby depressing the latter and plunger 40, thus actuating the switch 38 and energizing the heating coil and fan 34 for a predetermined period sufficient to allow snow, sleet, ice to melt and drain through the grill and upwardly punched dimple holes 30 into chamber 16 and to flow out through drain hole 52 in the bottom of the chamber 14 into a suitable drain.

I claim:

1. An instant hot air welcome mat comprising a housing adapted for mounting in a floor framing, said housing open at the top and provided with an outwardly extending flange thereat, a louvered vertical partition dividing said housing into an enclosed heating chamber and a drain chamber, a downwardly displaceable top cover for said housing having a solid portion for enclosing said heating chamber and a grilled portion for said drain chamber, the top cover having an outwardly extending flange and superposed with the housing flange, a heating element mounted in said heating chamber, a blower mounted in a wall of the heating chamber and in communication with the atmosphere, spring-loaded screws interposed between the housing and cover flanges to allow a downward depression of the cover against the bias of said spring-loaded screws, a delayed time trip switch secured to said housing for actuating said heating element and said blower for a predetermined time interval, and means secured to said cover flange and passing through the housing flange for operating said trip switch, said trip switch operating means aligned with but spaced apart from the switch means when the springs are relaxed, whereby a downward force applied by a person stepping on the cover causes the switch operating means to trip said switch thereby actuating the heating element and blower providing heated air to the drain chamber through the louvered partition for said predetermined time interval, the heated air passing through the grill to melt accumulated snow and ice on the cover and footwear alike, water therefrom draining into said drain chamber.

2. The device as claimed in claim 1 wherein said drain chamber is provided with a vee shaped, canted pan essentially horizontally positioned in the drain chamber, said pan having a multiplicity of upwardly punched dimple holes providing communication between the upper and lower portions of the drain chamber as formed by the pan, said pan also having a drain hole at the lowermost portion thereof.

3. The device as claimed in claims 1 or 2, wherein said drain chamber is provided with a drain outlet and a hose secured to said drain outlet for connection to a drain pipe.

4. The device of claim 3 wherein the means for operating the trip switch is a downwardly extending rod secured to the cover flange and passing through the housing flange, said rod contacting the switch plunger when the cover is depressed thereby actuating the heating element and blower simultaneously for said predetermined period of time.

* * * * *